United States Patent [19]

Davis

[11] 4,003,056

[45] Jan. 11, 1977

[54] WINDSHIELD ANTENNA SYSTEM WITH RESONANT ELEMENT AND COOPERATING RESONANT CONDUCTIVE EDGE

[76] Inventor: Ross Alan Davis, 724 Ala Moana Blvd., Honolulu, Hawaii 96813

[22] Filed: May 20, 1975

[21] Appl. No.: 579,149

[52] U.S. Cl. ..... 343/704; 343/713

[51] Int. Cl.[2] ..... H01Q 1/02; H01Q 1/32

[58] Field of Search ..... 343/711, 712, 713, 704

[56] References Cited

UNITED STATES PATENTS

| | | | |
|---|---|---|---|
| 3,484,584 | 12/1969 | Shaw | 343/713 |
| 3,771,159 | 11/1973 | Kawaguchi et al. | 343/713 |
| 3,810,180 | 5/1974 | Kunert et al. | 343/713 |
| 3,845,489 | 10/1974 | Sauer et al. | 343/713 |

*Primary Examiner*—Eli Lieberman

[57] ABSTRACT

An antenna system responsive to both the E and H fields in a radiated electromagnetic signal relies upon the placement within the influence of a conductive edge formed by an opening in a closed conductive body of an element having an effective electrical length which approximates a resonant length in free space in the intended range of operating frequencies for the antenna.

18 Claims, 13 Drawing Figures

WINDSHIELD ANTENNA SYSTEM WITH RESONANT ELEMENT AND COOPERATING RESONANT CONDUCTIVE EDGE

BACKGROUND OF THE INVENTION

1. Field of the Invention

This invention relates to the field of antennas and more specifically to conductive-body loop antennas.

2. Background of the Invention

I have developed various forms of antennas which relied upon the currents existing in a large conductive body, such as a car body. The advantage of such antennas is that they rely solely upon the H-field in a radiated signal and thus are relatively insensitive to corona and other forms of electrostatic noise. Further, they do not exhibit loss of signal in tunnels and in other environments where E-field antennas, such as a whip antenna, do not perform. However, the input impedance to such H-field systems is very low presenting problems in the use of such systems with conventional car radios, for example. Further, under some conditions, the E-field antennas exhibit higher sensitivity.

It is one object of this invention to overcome the problems set forth hereinbefore.

It is a further object of this invention to provide an antenna system which exhibits the desirable features of both E-field and H-field antennas.

It is a still further object of this invention to provide, in a conductive body, such as an automobile body, an antenna which exhibits sensitivity to the H-field but can be coupled effectively to a radio with an unmodified input circuit.

SUMMARY OF THE INVENTION

One or more antenna elements of generally a loop configuration and having an effective length which is resonant in the range of intended operating frequencies is or are placed within one or more openings in a conductive body, (that body acting as a collector of electromagnetic signals), the edge surrounding each such opening acting as the primary of a signal transformer driven by the conductive body signal source, the resonant element or elements in such opening acting as the secondary or secondaries of each such transformer. The degree of coupling of the secondary element or elements to the edge primary is chosen to permit the secondary to act partially as an E-field antenna and partially as an H-field antenna. The results obtained with the antenna systems according to this invention have shown the desirable performance characteristics of both E-field and H-field antennas.

DETAILED DESCRIPTION OF THE PREFERRED EMBODIMENTS

Figure 1:
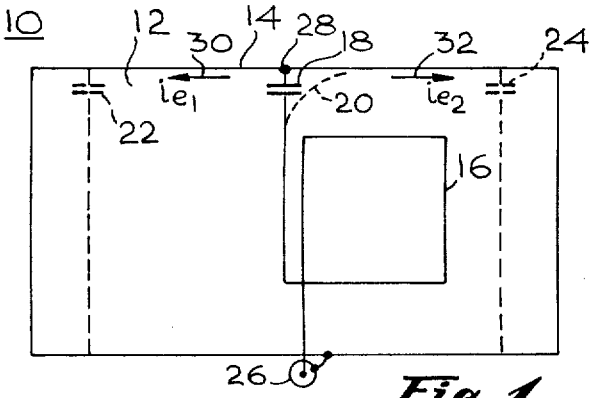
FIG. 1 is a schematic diagram of a first embodiment of the present invention.

In FIG. 1, conductive body 10 has an opening 12, therein, forming conductive edge 14. Loop 16, of wire or other conductive material, having a total electrically effective length approximating one-half wavelength at the intended operating frequency of the system, is supported in opening 12, as by being supported on the surface of or between layers of glass in a windshield of an automobile. Condenser 18 in which one end of loop 16 terminates, may be so small in size of capacitance as to require no discrete condenser at all. The end of loop 16 proximate to edge 14, by proper placement, may, as is indicated by the dotted line 20, exhibit sufficient capacitance in conjunction with edge 14 to provide the necessary coupling of loop 16 to edge 14 for signal transfer from edge 14 to loop 16 and sufficient end tuning of loop 16 to effect its desired resonance. For optimum performance it is desirable that the effective length of edge 14 be a resonant length in the intended range of operating frequencies. If the length of edge 14 is excessive for realizing natural resonance at the intended frequencies of operation its effective length may be reduced by adding "framing" condensers 22 and 24 (which are by-pass condensers exhibiting low reactance at the intended operating frequencies) along with their associated conductors 23, 25 and 27, 29, respectively. Signals from the antenna system are carried through to associated radio-apparatus cable 26. Body currents flow into point 28 on edge 14 and there split and flow in the directions indicated by arrows 30 and 32. At 88 megaherz, loop 16 has been found to perform well if its length is 66 inches with condenser 18 having a value (which may be adjustable) between 0.25 and 4 picofarads.

Figure 2:
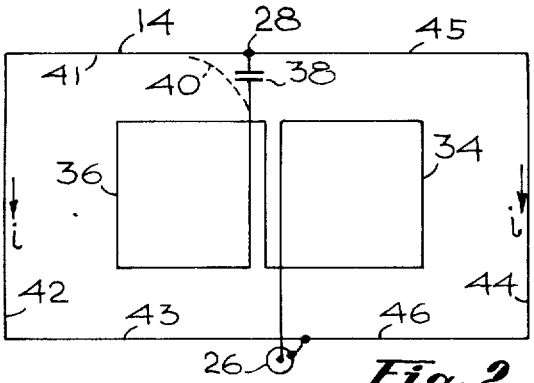
FIG. 2 is a schematic diagram of a second embodiment of the present invention showing a balanced form of the embodiment of FIG. 1.

In FIG. 2, loops 34 and 36, having a combined effective electrical length of approximately one wavelength in the operating range of frequencies, are provided. At 88 megaherz the length is approximately 132 inches. Condenser 38 is coupled between point 28 on edge 14 and one end of the conductor forming balanced loops 34 and 36. It performs the multiple functions of assuring end tuning of loops 34 and 36, and coupling conductive-body signals into the loops. Again, condenser 38, instead of being discrete, may comprise end 40 of loops 34 and 36 placed proximate to edge 14.

It is important to note the respective directions of winding of loops 34 and 36, namely their directions are reversed. The reason for that reversal is the direction of flow of body current in edge portions 41, 42 and 43 and in edge portions 44, 45 and 46, respectively. That is, as explained in connection with the discussion of FIG. 1, currents flow in opposite directions from point 28 along edge 14. Thus, if the direction of winding of loops 36 and 34 were not reversed the signal currents induced in loop 36 would oppose the signal currents induced in loop 34 and the resulting signal current flowing into cable 26 would be minimal. Again, framing condensers 22 and 24 and their associated framing conductors may be utilized to bring the effective length of the portions of edge 14 coupled to loop 36 and the effective length of the portions of edge 14 coupled to loop 34 near a condition of natural resonance in the range of operating frequencies.

Figure 3:
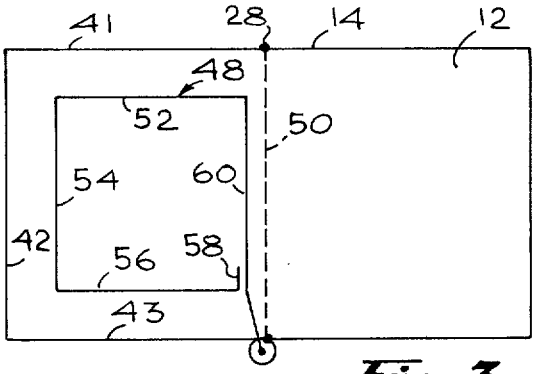
FIG. 3 is a schematic diagram of a further embodiment of the present invention showing a combined loop and dipole end-loading technique.

In FIG. 3, loop 48 is displaced from center line 50 of opening 12 so as to pick up signal currents from edge portions 41, 42 and 43, only, of edge 14. It is not coupled by a concentrated or discrete capacitance to edge 14. Further, loop 48 has its electrically conductive members or portions 52, 54 and 56 more proximate to edge 14 than are similar portions of loop 16 in FIG. 1 proximate to edge 14. As a result, tighter inductive coupling exists between loop 48 and edge portions 41, 42 and 43. To assure resonance of loop 48, portion 56 is, at its extremity or tuning end 58, made adjustable in position with respect to portion 60 of loop 48, such adjustment (by reason of its capacity-varying character) permitting end tuning of loop 48 to resonance in the band of desired operating frequencies. Varying the thickness of the dielectric, such as tape or resin, between end 58 and portion 60 also effects tuning of loop 60. The antenna configuration of FIG. 3 may also be viewed as an E-field-sensitive dipole antenna, end-loaded by itself, that is by the capacitive coupling between extremity 58 and portion 60.

Figure 4:
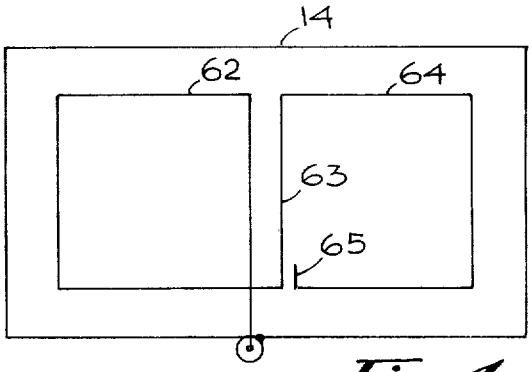
FIG. 4 is a schematic diagram of a balanced form of the embodiment of FIG. 3.

In FIG. 4, the concept of FIG. 3 is extended to a pair of balanced loops, 62 and 64, each having an effective electrical length approximating one-half wavelength, the overall length approaching a full wavelength at the desired operating frequency. The tuning of the loop to resonance in a desired band of frequencies is again accomplished by capacitive end tuning, i.e. by the proximity of end portion or tuning end 65 to loop conductor 63, a technique discussed in connection with the embodiment of FIG. 3. The "figure 8" disposition of the two series loops 62 and 64 is necessary to assure the addition, rather than the cancellation, of the signals induced in the respective loops, by their associated portions of edge 14, as was discussed in connection with the description of the embodiment of FIG. 2.

Figure 5:
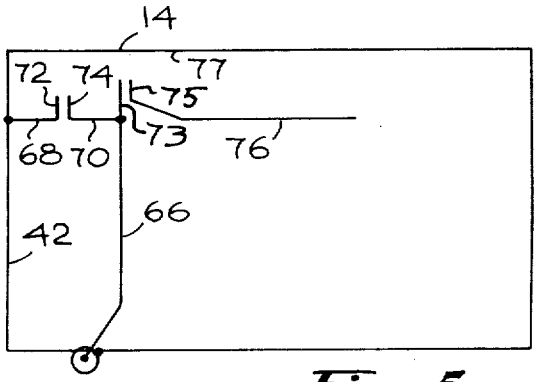
FIG. 5 is a still further embodiment, in schematic form, of an antenna system according to present invention.

In FIG. 5, element 66 is positioned proximate to portion 42 of edge 14. In actual experiments in the FM band in the United States, the separation of element 66 from edge portion 42 was 3 ½ inches. Elements 68 and 70, capacitively coupled to each other and end-tuned through end portions 72 and 74, respectively, close a resonant loop including those elements, element 66 and edge portion 42. Resonance of this loop in the desired band of operating frequencies is assured by varying the separation between or dielectric between end portions 72 and 74, that is, by varying the capacitance between ends portions 72 and 74, tuning of the loop including conductive edge portion 42 and element 66 is achieved. This technique permits maximizing antenna performance in production.

Element 76 is of essentially the same length as element 66 and provides additional signal pick-up by its coupling to free space and to edge portion 78 of edge 14 and, ultimately drives additional signal into the loop including conductor 66 and edge portion 42 as a result of its capacitive coupling thereto and end tuning thereby through ends 73 and 75. Because of the critical coupling of elements 66 and 76 to their adjacent edge portions they exhibit the characteristics of end-loaded antennas and have, for an effective quarter wavelength, a length much shorter than would be required for their resonance in free space. For example, at 88 megaherz for effective resonance the length of these elements is only 22 inches.

The antenna system of FIG. 5 has substantially a flat sensitivity curve over the band from 88 to 108 megahertz.

Figure 6:
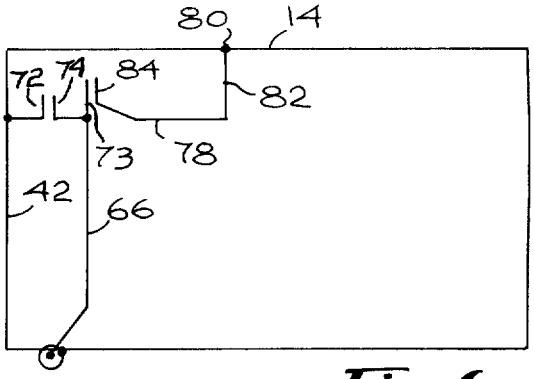
FIG. 6 is a schematic diagram of an alternate form of the embodiment of FIG. 5.

FIG. 6 shows a variation of the embodiment of FIG. 5. Element 78 is connected directly to edge 14 at point 80 and has a length of approximately 22 inches from point 82 to the end of portion 84 which is proximate to element 66. Conductor 78, at its maximum distance, is spaced approximately 3 ½ inches from portion 42 of edge 14, as in the embodiment of FIG. 5. Tests indicate that these dimensions produce a flat sensitivity response of the system of FIG. 6 in the FM band of frequencies from 88 to 108 megahertz when proper end tuning at 88 megahertz is effected by ends, 72, 74, and 73, 84, respectively.

Figure 7:
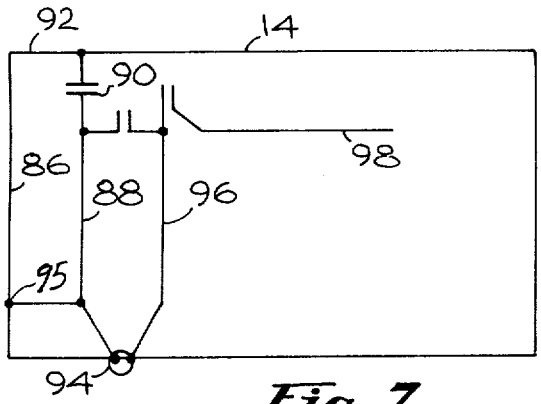
FIG. 7 is a further modification, in schematic form, of the embodiment of FIG. 5.

FIG. 7 illustrates a further variation of the embodiment of FIG. 5. Multiple loop antennas are involved. The first is made up of portion 86 of edge 14, conductor 88, condenser 90 and portion 92 of edge 14. For operation of the system in the FM band of 88–108 megahertz, condenser 90 should be of from 100–500 picofarads, framing conductor 88 from its juncture with framing condenser 90 to its juncture with edge 14 at point 95 should be approximately 22 inches and conductors 96 and 98 should also be 22 inches long, approximately. The spacing of conductors 88 and 98 from edge 14 should be about 3 ½ inches and the spacing of conductor 88 from conductor 96 should also be about 3 ½inches.

Figure 8:
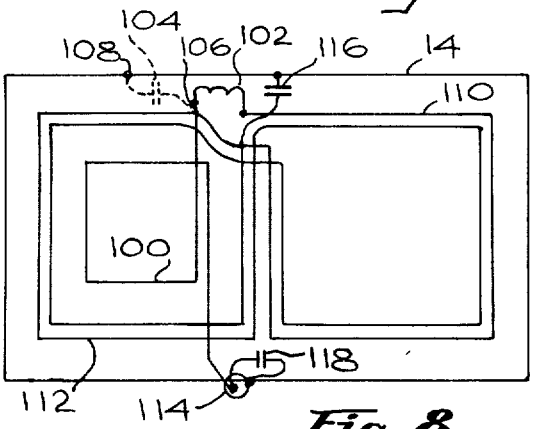
FIG. 8 is a schematic diagram of an extension of the embodiment of FIG. 1 into multi-band operation.

In FIG. 8, an antenna system operative in both the AM (550 – 1600 kHz) and FM (88 – 108 mHz) bands is disclosed. The loop 100 performs effectively in the aforesaid FM band. It is composed of one or two turns of wire having a total effective electrical length which is one-half wavelength or one wavelength in the FM band and terminates in r.f. choke 102 which is chosen to have such a magnitude of inductance that it stops the flow of r.f. currents in the FM band but not in the AM band. A discrete or "gimmick wire" capacitance 104 may be provided between point 106, at the terminus of loop 100, and point 108 on edge 14, to end tune loop 100 to resonance in the FM band. Such capacitance is so small (0.25 to 4 pfd) as not to adversely affect AM signals. R.F. signals in the AM band flow through choke 102, experiencing essentially no impedance at those frequencies, and into loops 110 and 112, which have such winding directions as to result in a figure 8 configuration. These loops pick up signals in the AM band both from edge 14 and from directly incident radiation. Those signals are combined constructively and are fed to associated radio apparatus through cable 114. Resonance of the loops 110 and 112 in the AM band is assured by reason of capacitance 116, which may be a discrete component or the inherent capacitance between the end of loop 112 and edge 14. As the number of turns in loops 110 and 112 increases, the required magnitude of condenser 116 for resonance decreases until the distributed capacitance between loops 110 and 112 and edge 14 is sufficient to resonate loops 110 and 112 in the AM band. Padding or matching condenser 118 may be provided.

Figure 9:
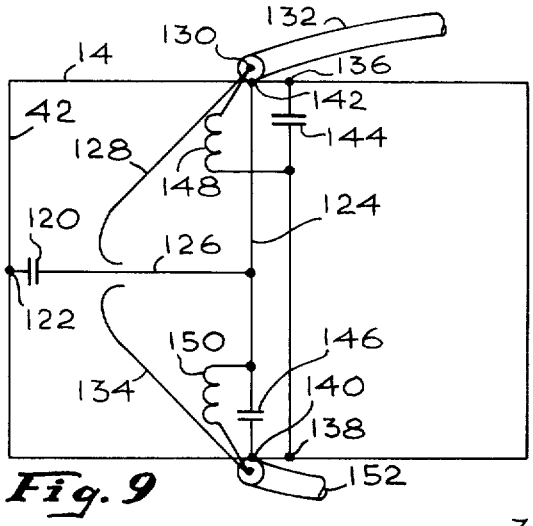
FIG. 9 is a schematic diagram of an extension of the embodiment of FIG. 5 into multi-band operation.

In FIG. 9, combined FM-AM performance is achieved by a resonant system which relies primarily on H-field currents at AM and both H and E-field currents on FM. Portion 42 of edge 14 is reduced in effective length by framing condenser 120 which is connected, on one end, to midway point 122 on portion 42 and on the other end to drive wire 124 by way of framing conductor 126. Conductor 128 is connected at one end to inner conductor 130 of cable 132 and its other end is positioned proximate to conductor 126. The capacitance of condenser 120 is chosen so that it acts as a low-reactance by-pass condenser at frequencies in the FM band. As a result, signal currents in that band flow freely in conductor 126. The proximity of conductor 128 to conductor 126 results in capacitive coupling thereto, tuning and the completion of the loop including conductor 128, that portion of conductor 126 between the proximate end of conductor 128 and drive wire 124, and the upper half of conductor 124. The length of conductor 128 for optimum performance in the FM band previously described has been found to be 22 inches, approximately. Experiments have further disclosed that the length of conductor in the remainder of the loop including conductor 126 should be 22 inches, approximately.

A similar analysis applies to the operation of the FM antenna including conductor 134.

Antenna operation in the AM range of frequencies, i.e. 550 to 1600 kHz, relies upon the flow of AM signal currents in edge 14 and the resultant potential difference between points 136 and 138 and 140 and 142, respectively. Condenser 144 resonates the loop, including conductive edge 14, at approximately 1600 kHz. Condenser 146 resonates the loop including conductive edge 14 at approximately 1300 kHz. Impedance matching coils 148 and 150, which are effective R.F. chokes at FM band frequencies, maintain the resonant-length character of FM antenna conductors 128 and 134, respectively. Inductances 148 and 150 do not block the flow of signals in the AM band of frequencies because, at those frequencies their impedances are extremely low. In fact, they may be caused to series resonate with their associated condensers 144 and 146, respectively. AM and FM signals are carried by each of the cables 132 and 152 to associated radio apparatus, not shown.

Figure 10:
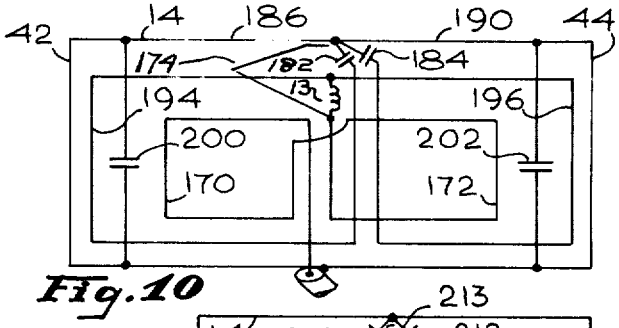
FIG. 10 is a schematic diagram of a two-band, resonant balanced-loop antenna system according to the present invention.

In FIG. 10 the combination E-field and H-field antenna includes two loops 170 and 172 operating in series and end tuned to resonance at the desired operating frequency by gimmick wire 174 which, in combination with edge 14, forms a condenser. A discrete condenser may be substituted for the condenser including wire 174. For antenna operation in low and high frequency portions of the radio spectrum, simultaneously, as for example in the FM band and the AM band, RF choke 13 acts as a very high impedance at FM frequencies but not at AM frequencies and may be inserted between the end of loop 172, as shown in FIG. 10, and loops 194 and 196, the latter loops each having a sufficient number of turns to assure satisfactory AM band operation. The ends of loops 194 and 196, respectively terminating in tuning elements 182 and 184, respectively, which effect resonance of the associated loops, including the edge portions 42, 186 and 188, and 44, 190 and 192 which act as the primaries of a pair of transformers of which loops 170, 172, 194 and 196 are the secondaries. It should be noted that, while loops 170, 172, 194 and 196 are shown in FIG. 10 as having only one turn, they may be extended to as many turns as are necessary to achieve the desired resonance and signal pick-up. Further, it is to be noted that loops 194 and 196, which are intended to operate at frequencies in the AM band, are positioned more proximate to edge 14 than are the FM loops. This positioning is intended to assure a greater inductive coupling from conductive edge 14 to the AM loops 194 and 196 than to FM loops 170 and 172. Point 198 on edge 14 is the maximum signal voltage point on that edge at frequencies in the AM band.

For optimum performance of FM loops 170 and 172 it may be necessary to add framing condensers 200 and 202, which are by-pass condensers at frequencies in the FM band and effectively shorten the length of edge 14 for FM signals, the objective being to achieve resonance of the edge portions acting as the transformer primary in the FM loop case.

Figure 11:
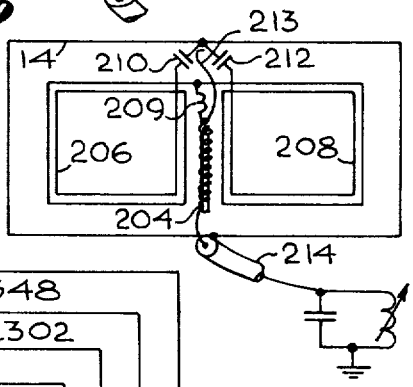
FIG. 11 is a schematic diagram of a further resonant antenna system according to my invention.

In FIG. 11, helix 204 is wound with widely spaced turns on a rod made of insulating material, for example, plastic or glass, and acts as the FM antenna in the dual-band system which includes, in addition, loops 206 and 208. Helix 204 is coupled, through FM-signal-isolation choke 209, in series with both loops 206 and 208 at frequencies in the AM band. Loops 206 and 208 are positioned with three of their respective sides proximate to conductive edge 14 for maximum pick-up of RF currents flowing therein. Condensers 210 and 212 end tune and resonate loops 206 and 208 at frequencies in the AM band and may be discrete or, with large numbers of turns in loops 206 and 208, respectively, distributed. Both FM and AM signals from the system flow out through cable 214 to associated radio apparatus.

Gimmick wire 213, which is connected at one end to helix 204 has its remaining end adjustably positioned proximate to conductive edge 14 to effect tuning of helix 204 to resonance in the desired range of operating frequencies.

Figure 12:
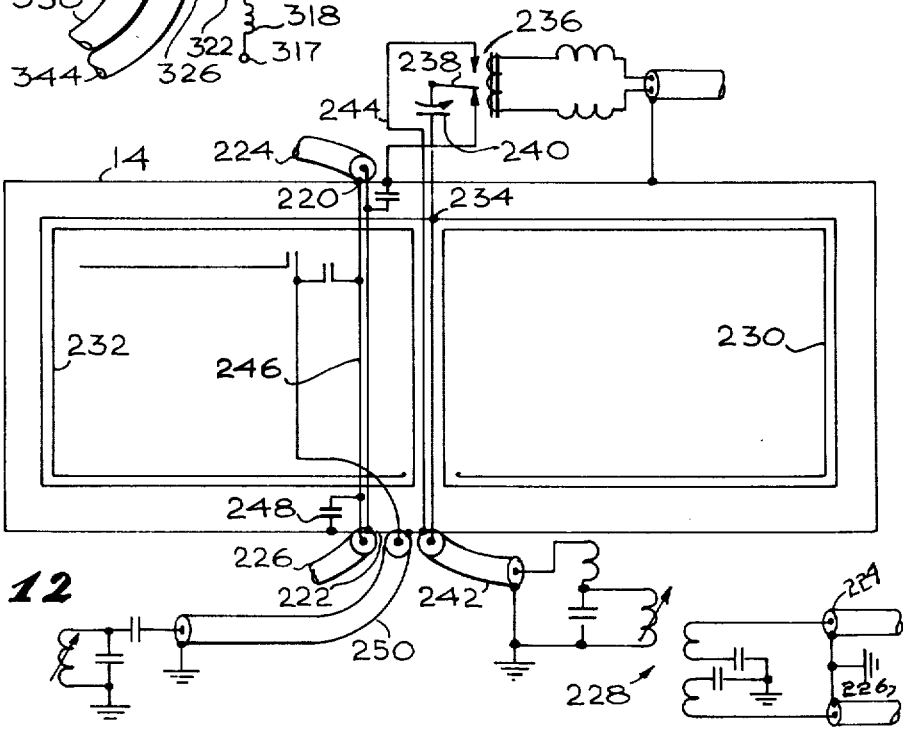
FIG. 12 is a schematic diagram of an antenna system incorporating antenna switching means, all according to my invention.

An experimental installation which has proven very effective as a combined E and H-field antenna is shown in FIG. 12. Signals at frequencies in the AM band flow about edge 14 and produce potential differences between points 220 and 222. Those potential differences are applied to coaxial cables 224 and 226 and are applied, in opposite phase, to coupling circuits 228 in associated radio apparatus.

Loops 230 and 232 are wound in opposite direction to provide aiding currents at point 234. The currents in loops 230 and 232 are induced therein by currents flowing along conductive edge 14, as has been described earlier herein. Despite the open-ended nature of loops 230 and 232, both of these loops exhibit the capability of responding to both the E and H fields. That the loops respond to currents flowing in conductive edge 14 is easily shown with the circuit of FIG. 12. Relay 236 is of the single-pole, double-throw variety. With moving contact 238 in the position shown, point 234 on loops 230 and 232 is coupled through resonating capacitor 240 to edge 14, substantially at point 220. Resonating capacitor 240 can be adjusted to resonate loops 230 and 232, and the surrounding conductive edge 14, to resonance in the AM band of frequencies. When this is done, substantial signals in that band (assuming that the associated conductive body is in a corresponding electromagnetic field) are supplied to cable 242 for coupling to circuits 228. If relay 236 is energized, moving contact 238 then connects tuning capacitor 240 to lead 244 which is connected, essentially, to point 222 on the lower portion of edge 14. Tuning capacitor 240 is no longer connected to high signal strength point 220 on edge 14 and the signal coupled to the associated radio apparatus, now shown, under these conditions drops significantly.

The FM antenna for this system corresponds to that of FIG. 5, utilizing driving wire 246, in combination with capacitor 248, as a framing wire. FM signals are taken to associated radio apparatus, not shown, through cable 250.

Figure 13:
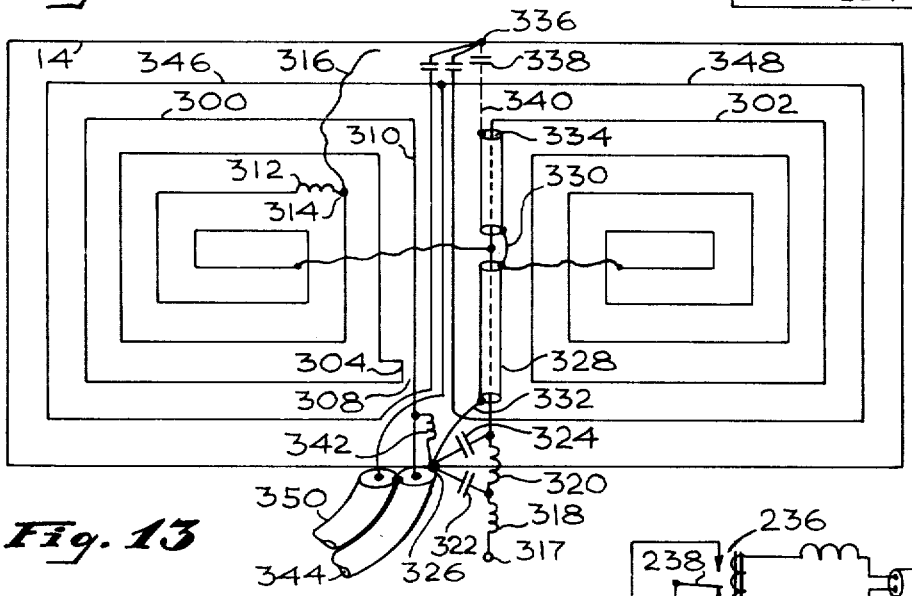
FIG. 13 is a schematic diagram of an embodiment of my antenna system in which elements of the antenna also serve a defrosting function.

In FIG. 13, loops 300 and 302 are formed with heating wire or ribbon made of such material as a nickel-chromium alloy which exhibits slow oxidation at elevated temperatures, and one purpose of the loops being to act as defrosters in the window in which they are carried. Loop 300 may have a portion 304 positioned proximate to element 306 to form a capacitor 308 with the proximate portion of element 310 thus effecting tuning of a first portion of loop 300 having an effective electrical length of one-half wavelength. The loop 300 is effectively terminated for FM signal purposes by the interposition of RF choke 312 which exhibits high impedance in the 75 to 110 MHz (FM) band but low impedance to the d.c. heating current which passes through it. Choke 312 may be formed of the defroster wire or ribbon itself by disposing it in serpentine fashion with closely spaced members to assure significant inductive reactance, or it may be a separate choke element interconnected between portions of loop 300, as shown. End tuning of the loop portion beginning at portion 304 and ending, for RF purposes, at point 314 (to constitute an effective half-wave at FM frequencies) is effected by gimmick wire 316 which is connected to point 314 and terminates proximate to conductive edge 14.

In the embodiment of FIG. 13 loop 302 serves only as a defroster but, applying the principles used in connection with loop 300, it may be caused to act as a tuned loop in another range of frequencies, if desired.

Direct current from the above-common side of the power source, arriving at terminal 317, is filtered by chokes 318 and 320 in combination with by-pass condensers 322 and 324, the latter being connected to a common grounding point 326. The d.c. return path for loop 302 is through shielding sheath 328 in which loop 302 terminates at point 330. Sheath 328 is connected by lead 332 to common grounding point 326.

Sheath 334 may be coupled (for further shielding of the antenna system from car-generated electrical noise) to point 336 on edge 14, by condenser 338 having a magnitude of 100 to 500 picofarads. This combination of lead 332, sheath 328, sheath 334, lead 340 and condenser 338 may be used, also, for framing an oversized opening to cause it to operate acceptably at high frequencies as described hereinbefore.

Choke 342 performs the dual functions of providing a d.c. return path for loop 300 and a matching coil to coaxial cable 344.

Signals in the AM band are intercepted by loops 346 and 348 and taken to associated receiving apparatus by cable 350, the outer conductor of which is grounded to point 326.

It is to be noted that both the FM and AM signal cables as well as choke 342, filter condensers 322 and 324 and sheaths 334 and 328 are connected to a common grounding point 326. In the past the grounding point for the defroster has not been common with the grounding point for the antenna cables. Because of the use of H-field body currents in this invention, this inventor has chosen a common grounding point and that point corresponds to the lowest signal voltage point in the body-current antenna system. As a result, ground loops and excessive noise are avoided in the signals fed to associated radio apparatus.

While separate cables are shown for carrying FM and AM signals, respectively, to associated radio apparatus a common cable may be utilized.

While particular embodiments of my invention have been shown and described, it will be obvious to those skilled in the art that changes and modifications may be made without departing from my invention in its broader aspects and, therefore, the aim of the appended claims is to cover all such changes, and modifications as fall within the true spirit and scope of my invention.

I claim:

1. A conductive-body vehicle-antenna system responsive to both E-field and H-field electromagnetic signals, including:

an electrically conductive vehicle body having at least one window opening therein to form a conductive edge;

a plurality of intercoupled, electrically conductive members serially disposed on said window to form at least one loop having a total electrically effective length approximating one-half wavelength at an intended operating frequency of the system, said at least one loop being spaced from, but electrically coupled to said edge, the end conductive member having a tuning end;

tuning means coupled to said tuning end for producing electrical resonance of said at least one loop in a predetermined range of frequencies;

and, means for coupling to external circuits signals from said at least one loop.

2. Apparatus according to claim 1 in which said tuning means are capacitive.

3. Apparatus according to claim 1 in which the number of loops formed by said conductive members is two and each loop has an end conductive member with a tuning end and said tuning means resonate such loops in first and second ranges of frequencies, respectively.

4. Apparatus according to claim 3 in which said first range of frequencies is 550 to 1600 KHz and said second range of frequencies lies in the portion of the radio spectrum between 77 and 110 MHz.

5. Apparatus according to claim 1 in which said tuning means is coupled between said tuning end and said conductive edge.

6. Apparatus according to claim 1 in which said tuning means includes said tuning end and a cooperating one of said conductive members.

7. Apparatus according to claim 3 in which said tuning means are coupled between each of said tuning ends and said conductive edge.

8. Apparatus according to claim 1 in which the number of loops formed by said conductive members is four, three of such loops having a conductive member with a tuning end and said tuning means comprises three capacitors each coupling one of said tuning ends to said conductive edge.

9. Apparatus according to claim 8 in which a first two of said loops are tuned by a first two of said capacitors, respectively, to resonate in a first range of frequencies and the remaining two of said loops are tuned by the remaining two of said capacitors to resonate in a second range of frequencies.

10. Apparatus according to claim 9 in which said first two loops are wound in opposite direction with respect to each other and said remaining two loops are wound in opposite directions with respect to each other.

11. Apparatus according to claim 1 in which said at least one loop includes at least one loop in which said conductive members include heating wires and such heating wires are intercoupled to form a combined defroster-antenna.

12. Apparatus according to claim 1 in which the number of loops formed by said conductive members is at least three, two of which terminate in a first tuning end, the third terminating in a second tuning end;

tuning means coupled between said first and second tuning ends and said conductive edge for resonating said two loops in a first range of frequencies and said third loop in a second range of frequencies.

13. Apparatus according to claim 12 in which an R-F choke is connected between said two loops and said third loop, said R-F choke being effective to prevent the flow therethrough of signals in said second range of frequencies.

14. A vehicle antenna system including:

a window opening having a conductive perimeter and being responsive to a radio frequency field at a given frequency to produce in said conductive perimeter a flow of current at said frequency;

a first conductive loop and a second conductive loop disposed on said window, each having at least a portion thereof juxtaposed to a portion of said conductive perimeter, each having a total electrically effective length approximating one-half wavelength at an intended operating frequency of the system and each having a tuning end; and, capacitive means coupling each of said tuning ends to said conductive perimeter for resonating said first conductive loop in a first range of frequencies and said second conductive loop in a second range of frequencies.

15. Apparatus according to claim 14 including, in addition, means common to both said first and second loops for coupling said loops to external circuits.

16. Apparatus according to claim 15 in which said first and second loops are interconnected by an R-F choke.

17. Apparatus according to claim 16 in which said R-F choke presents a high impedance in said first range of frequencies and a low impedance in said second range of frequencies.

18. Apparatus according to claim 14 in which said first conductive loop has a first end in addition to said tuning end; and an R-F choke connected between said first end of said first conductive loop and said tuning end of said second conductive loop.

* * * * *